US005337900A

United States Patent [19]

Abbott et al.

[11] Patent Number: 5,337,900

[45] Date of Patent: Aug. 16, 1994

[54] FLOOR RECOVERY HOPPER AND SYSTEM THEREWITH

[75] Inventors: Kenneth E. Abbott; Patrick J. Lyons, both of Tucson, Ariz.

[73] Assignee: Stripping Technologies, Inc., Tucson, Ariz.

[21] Appl. No.: 39,878

[22] Filed: Mar. 30, 1993

[51] Int. Cl.[5] ..... B07B 1/28

[52] U.S. Cl. ..... 209/257; 209/258; 209/321; 209/357; 209/371

[58] Field of Search ..... 209/255-258, 209/321, 347, 357, 925, 370, 371, 391

[56] References Cited

U.S. PATENT DOCUMENTS

| | | | |
|---|---|---|---|
| 1,438,125 | 12/1922 | Martin | 209/258 X |
| 1,439,252 | 12/1922 | Martin | 209/258 X |
| 2,370,717 | 3/1945 | Christman, Jr. | 209/255 X |
| 4,222,866 | 9/1980 | Wilson | 209/257 X |
| 4,276,158 | 6/1981 | Görlitz | 209/255 |
| 4,927,534 | 5/1990 | Riihimäki | 209/255 X |

*Primary Examiner*—D. Glenn Dayoan
*Attorney, Agent, or Firm*—Ogram & Teplitz

[57] ABSTRACT

A media recovery hopper which lies on a floor permitting spent media and debris to be swept thereinto. The hopper, in the preferred embodiment, is a substantially rectangular box having one of its four side walls shorter than the rest. The media/debris is swept over this shorter side wall while the other walls collect and "queue" the mixture for recovery. The mixture falls through a screen and into a channeling mechanism composed of a series of ridges and valleys. Along each valley are drop-orifices which permit the media/debris mixture to fall therethrough and into an air-stream which carries the mixture to proper collection or sorting mechanism.

25 Claims, 4 Drawing Sheets

FLOOR RECOVERY HOPPER AND SYSTEM THEREWITH

BACKGROUND OF THE INVENTION

This invention relates generally to abrasive blast media and more particularly to recovery systems therefor.

In an abrasive blasting situation, a media, such as sand or plastic, is propelled under air pressure to impact upon a targeted surface. The impact causes the surface to abrade and thereby strips the surface of paint, rust, or other such matter.

The media, once impact has occurred, looses the vast majority of it's momentum and the media, mixed now with debris from the surface, falls onto the floor. This media/debris mixture must be collected and separated so that the reusable media may again be utilized and the debris discarded.

This collection has traditionally taken a variety of approaches, all of which recycle the mixture through the abrasive blasting equipment's own dust collection system.

One method which has been used is a manual shoveling of the mixture from the floor into a hopper which feeds the dust collection system. Although this is effective, it is extremely time consuming and requires the shut-down of the operation during this "clean-up" process. Additionally, many recovery systems are incapable of handling a "slug" of mixture; to compensate, the shoveling action must be paced so as not to exceed the system's capacity.

Several floor recovery hoppers using pneumatic or mechanical conveyance systems have been developed. These systems, built into the floor of the room, permit the falling mixture to pass through to a conveyance mechanism. In some applications, a screw mechanism is used as an auger to move the mixture to the dust collection apparatus.

Although this method is effective, it requires the hopper to be built into the floor itself; often this is not feasible, especially in a retro-fit situation.

To cure the installation problem, a variety of hoppers have been developed which lay on the floor and permit the mixture to be swept up to the collection apparatus. The mixture, once it is swept into the collection apparatus is moved along, typically through pneumatic force, to the dust collection operation.

These devices, although installation is relatively easy, are not always effective and often require much more time than the shoveling solution discussed earlier.

Further, the retro-fit devices of the current art rely upon pneumatic conveyance mechanisms. As such, should the operator sweep a large volume of media/debris into the hopper, the mass of the mixture is usually sufficient to cause the pneumatic conveyance to breakdown and operate only marginally.

In practice, this means that the operator gently sweeps the mixture into the hopper, waiting for one portion to be conveyed away before the next load is pushed into the hopper. This is a slow process; all the while, the abrasive blasting operation is waiting for the spent media and debris to be cleared.

It is clear from the foregoing that there is a need for an easy and quick method and apparatus to clear spent media and debris from an abrasive blast site.

SUMMARY OF THE INVENTION

The invention is a media recovery hopper which lies on a floor permitting spent media and debris to be swept thereinto. The hopper, in the preferred embodiment, is a substantially rectangular box having one of its four side walls shorter than the rest. The media/debris is swept over this shorter side wall using a ramp. While the other walls collect and "queue" the mixture for recovery. The mixture falls through a screen and into a channeling mechanism composed of a series of ridges and valleys. Along each valley are drop-orifices which permit the media/debris mixture to fall therethrough and into an air-stream which carries the mixture to the proper collection or sorting mechanism.

In the preferred embodiment, the hopper is a substantially rectangular box having one of its sides lower than the rest. This lowered side has a ramp attached to it. The media/debris is swept up the ramp and over the shorter side. The other three sides, being taller, hold the media/debris from falling off the hopper and thereby queue the mixture until such time as the hopper is able to convey it along to the typical dust collection mechanism.

In this preferred embodiment, the mixture first passes through a vibrating screen. This screen accomplishes two tasks: (i) it prevents large pieces of debris from getting into and fouling the mechanism; and (ii) the screen disperses the mixture over a broader range.

The mixture falling through the screen falls onto a channeling mechanism which is a series of ridges and valleys. Along each valley are a series of drop holes which permit the mixture to fall into an air flow channel at the bottom of the hopper.

This air flow channel is supplied ambient air from one end of the hopper, via orifices in the bottom thereof, to the other end of the hopper.

Through the use of the screen and the channeling means, the rate of application of the mixture to the air stream within the air flow channel is controlled as not to overwhelm the system and cause a break-down; but, because of the three higher walls, the screen, and the channeling features, a large queue of mixture is kept at bay and is handled as the equipment is able to handle it. The operator need not be bothered with monitoring the system to make sure it is handling the processing properly as the system is designed to compensate for it's limitations.

The air flow channel communicates with an adapter which converts the generally flat channel into a circular channel suitable for traditional pipe ducting. This adapter connects to the suction mechanism which draws the media/debris mixture to a bag house or other mechanism used to separate the reusable media from the debris.

In this preferred embodiment of the invention, the screen is vibrated to assure the mixture from lodging therein. This vibration is supplied through a variety of mechanisms well known to those of ordinary skill in the art; but, the preferred embodiment uses air pressure to power the vibrator.

In one embodiment of the invention, the cross-sectional area of the circular channel is used as a maximum value for either the orifice permitting air into the air flow channel, or the drop orifices. By keeping both the air flow channel cross sectional area, and the drop orifices total cross sectional area, is equal to or less than the cross-sectional area of the circular channel (through which the suction mechanism works), the apparatus is assured that even if the hopper is in an a-typical load distribution, the apparatus will continue to draw air through the air flow channel and will eventually clear the channel.

In one embodiment of the invention, a wind-speed indicator is placed either in the adapter or the air flow channel to gauge the air flow being obtained. A controller monitors this actual air flow and compares it to a desired air flow; the suction mechanism is adjusted by the controller so that the actual air flow approximates the desired air flow.

This attribute of this embodiment even further assures that a "wad" of media/debris is unable to overwhelm the system; as the "wad" enters the system and slows up the air flow, suitable compensation is made to maintain the preferred air flow.

As an even further precaution, in one embodiment of the invention, the drop orifices communicate with conduits which are selectively activated through the use of valves. If a particular conduit becomes clogged due to excess mixture being applied thereto, additional suction is applied to that conduit until it normalizes with the others.

This aspect of the invention is easily implemented through a variety of mechanisms well known to those of ordinary skill in the art.

The invention, together with various embodiments thereof, will be more fully described by the following drawings and their descriptions.

DRAWINGS IN BRIEF

DRAWINGS IN DETAIL

Figure 1:
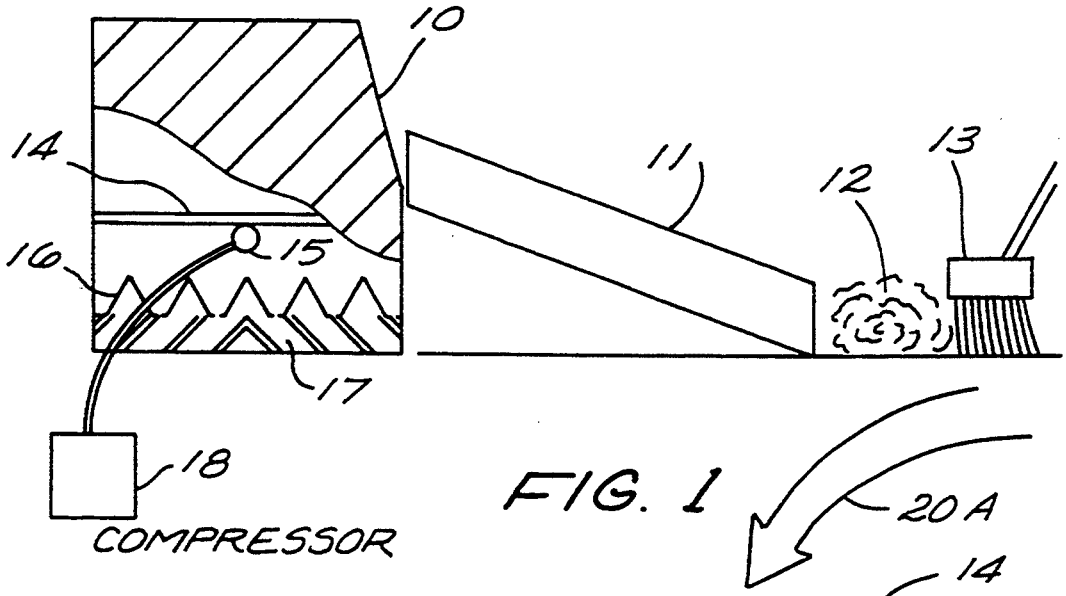
FIG. 1 is a side cutaway view of the preferred embodiment of the invention illustrating the hopper in operation.

FIG. 1 is a side cutaway view of the preferred embodiment of the invention illustrating the hopper in operation.

Media/debris 12 is swept by broom 13 up ramp 11 and into hopper 10. The media/debris 12 then falls through screen 14 and lands on channeling apparatus 16. The mixture of media/debris 12 is agitated by shaker 15 which shakes screen 14 and discourages the lodging and packing of the media/debris at the screen layer. This vibration, of shaker 15, is supplied through a variety of mechanisms well known to those of ordinary skill in the art; but, the preferred embodiment uses air pressure, from compressor 18, to power shaker 15.

Channeling apparatus 16 has a series of ridges and valleys. The media/debris falls into the valleys where holes, not shown, permit the mixture to fall into the air-channel 17. This air channel communicates, not shown, with the typical media recovery system well known to those in the art.

Figure 2:
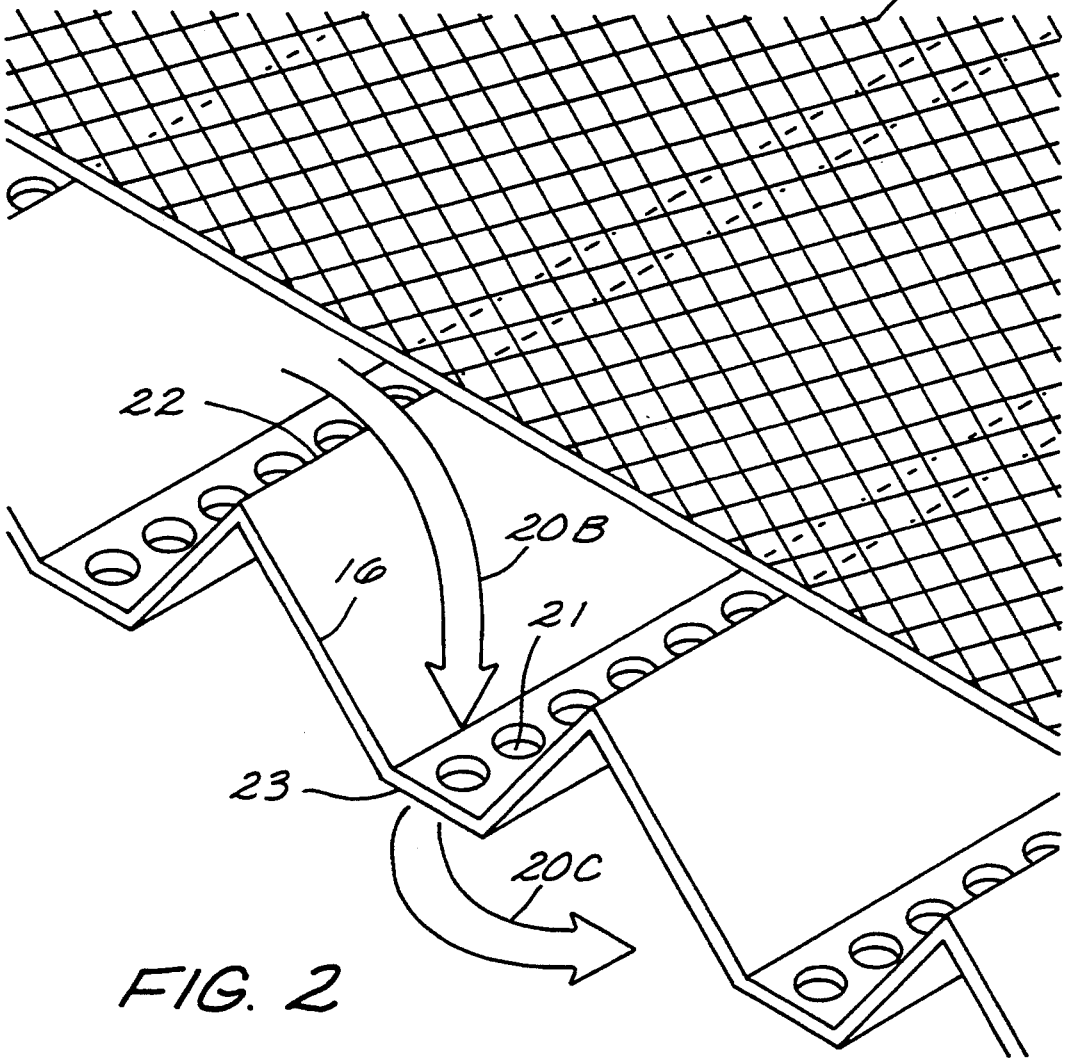
FIG. 2 is a perspective component view illustrating the movement of the media/debris once it enters the preferred hopper.

FIG. 2 is a perspective component view illustrating the movement of the media/debris once it enters the preferred hopper.

Screen 14 is used to collect the larger particles and prevent them from entering the hopper. Additionally, screen 14 tends to spread-out the media/debris mixture so that the mixture falls more evenly over the channeling apparatus 16.

The media/debris is swept onto screen 14 as indicated by arrow 20A and falls through the screen as indicated by arrow 20B. As indicated, the mixture falls down ridge 22 to valley 23 where drop orifice 21 permits the mixture to pass therethrough and into the air channel as indicated by arrow 20C.

Through the use of ridges and valleys, and where each valley has a selected grouping of holes, the overall surface area in which suction or dropping action is required is reduced to an acceptable level, permitting the suction motor to be of modest size.

Figure 3:
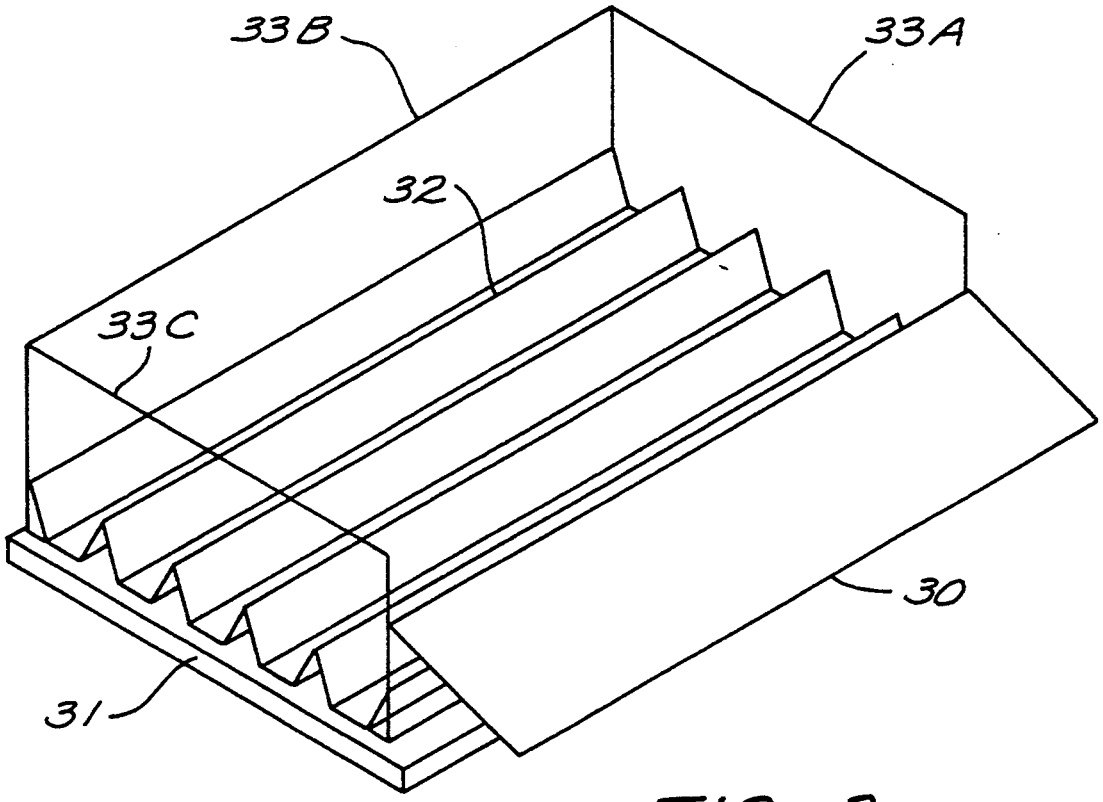
FIG. 3 is a perspective view of an embodiment of the invention.

FIG. 3 is a perspective view of an embodiment of the invention.

The mixture of media/debris, not shown, is swept up ramp 30 and onto the screen (not shown in this illustration). Side panels, 33A, 33B, and 33C, extend perpendicular to the base plate and air channel 31. These side panels are used to collect the media/debris mixture and hold it in place until such time that it falls through the screen and onto the channeling apparatus 32.

When the mixture falls through and into the air channel 31, it is swept away and handled in traditional methods.

Figure 4:
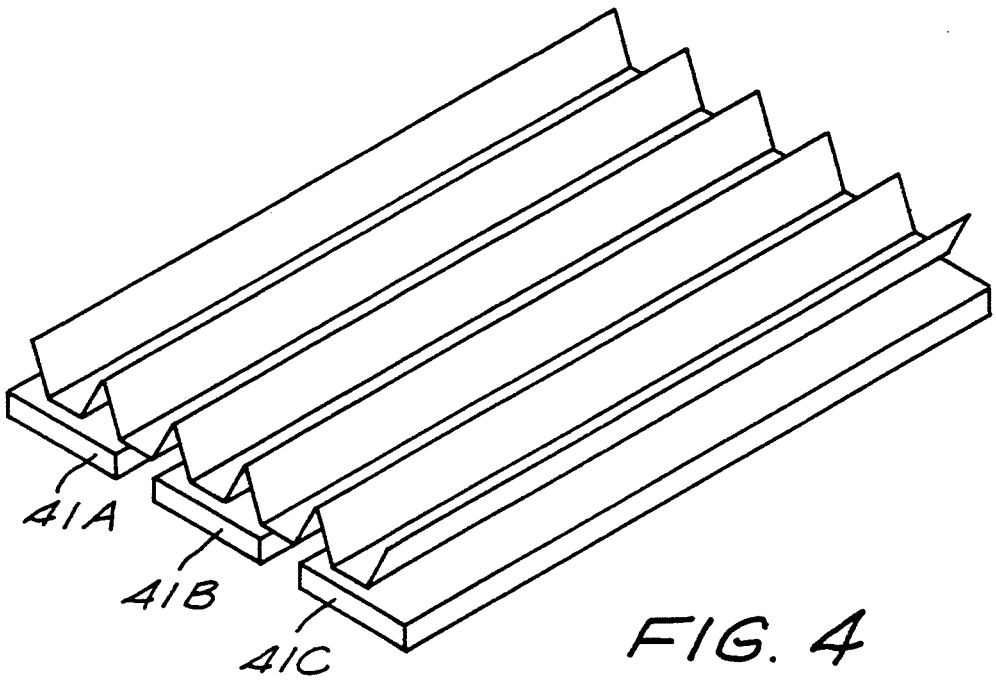
FIG. 4 is a perspective view of an embodiment of the channeling means with conduit.

FIG. 4 is a perspective view of an embodiment of the channeling means with conduit.

In this embodiment, conduits 41A, 41B, and 41C are utilized. Each conduit addresses a select grouping of drop orifices, not shown, in the channeling means. With the use of conduits, the suction which is applied is selectively amplified by applying the suction to one conduit 41A, then the second conduit 41B, then the third conduit 41C, and then back to the first conduit 41A.

In this manner, although there are more drop orifices then the suction can handle at one time, through the cycling operation, the entire suction is applied to a single bank of drop orifices.

Figure 5A:
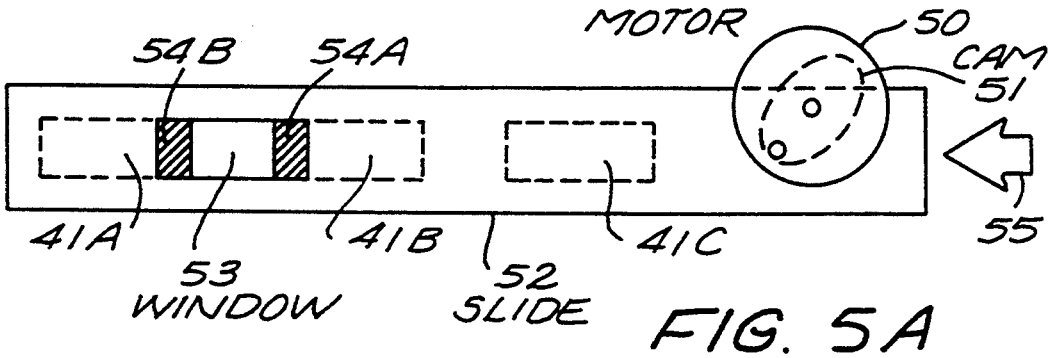
FIG. 5A and 5B are alternative embodiments of the valving means used to direct air-flow into the air-flow channel.
Figure 5B:
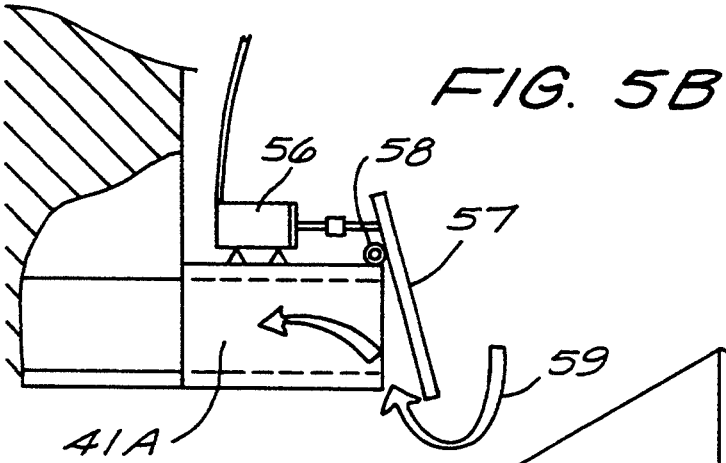

FIG. 5A and 5B are alternative embodiments of the valving means used to direct air-flow into the air-flow channel.

Although there are a variety of methods which can be used to direct the suction, the preferred embodiment is illustrated in FIG. 5A which operates in conjunction with the conduits of FIG. 4.

The valve of FIG. 5A is a slide 52 which overlays conduits 41A, 41B, and 41C. Opening/window 53 in slide 52 is caused to pass, as shown by arrow 55, in front of conduits 41A, 41B, and 41C. As window 53 passes in front of a portion or all of the conduit, air openings, such as 54A and 54B, are created which permit air to flow into the conduit.

As shown in this example, conduits 41A and 41B each are receiving some suction/air flow while conduit 41C is completely closed off.

Motor 50, in conjunction with cam 51 causes slide 52 to move back and forth at the chosen speed and thereby selectively open each of the conduits in succession.

An alternative embodiment is shown in FIG. 5B in which active valves are created on each conduit. In this illustration, conduit 41A has associated with it solenoid 56 which operates gate 57 fastened on hinge 58. Through control signals from a computer or the like, not shown, solenoid 56 opens or closes gate 57 and thereby relaxes or restricts air-flow 59 into conduit 41A.

This embodiment is particularly useful where a complete and absolute control of the air flow is sought. Through the use of such a valve on each of the conduits, the air flow through each conduit is accurately controlled.

Figure 6:
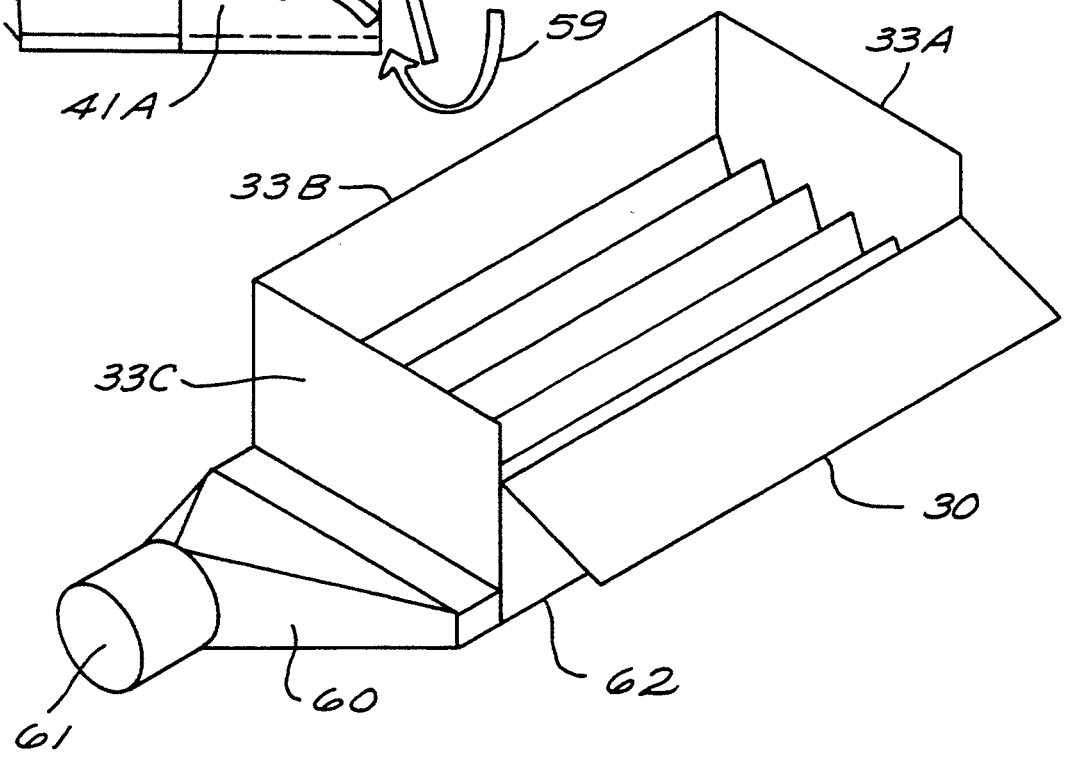
FIG. 6 is a perspective view of the preferred embodiment of the invention illustrating the adapter mechanism.

FIG. 6 is a perspective view of the preferred embodiment of the invention illustrating the adapter mechanism.

Preferably located at the other end of the valves discussed relative to FIGS. 5A and 5B, is adapter member 60 which converts a Generally flat rectangular air channel into a round pipe 61 which is easily to connected to conventional ducting.

Again, as shown and discussed before, this embodiment utilizes ramp 30, side panels 33A, 33B, and 33C, together with channeling means 32 to create a hopper 62.

Figure 7:
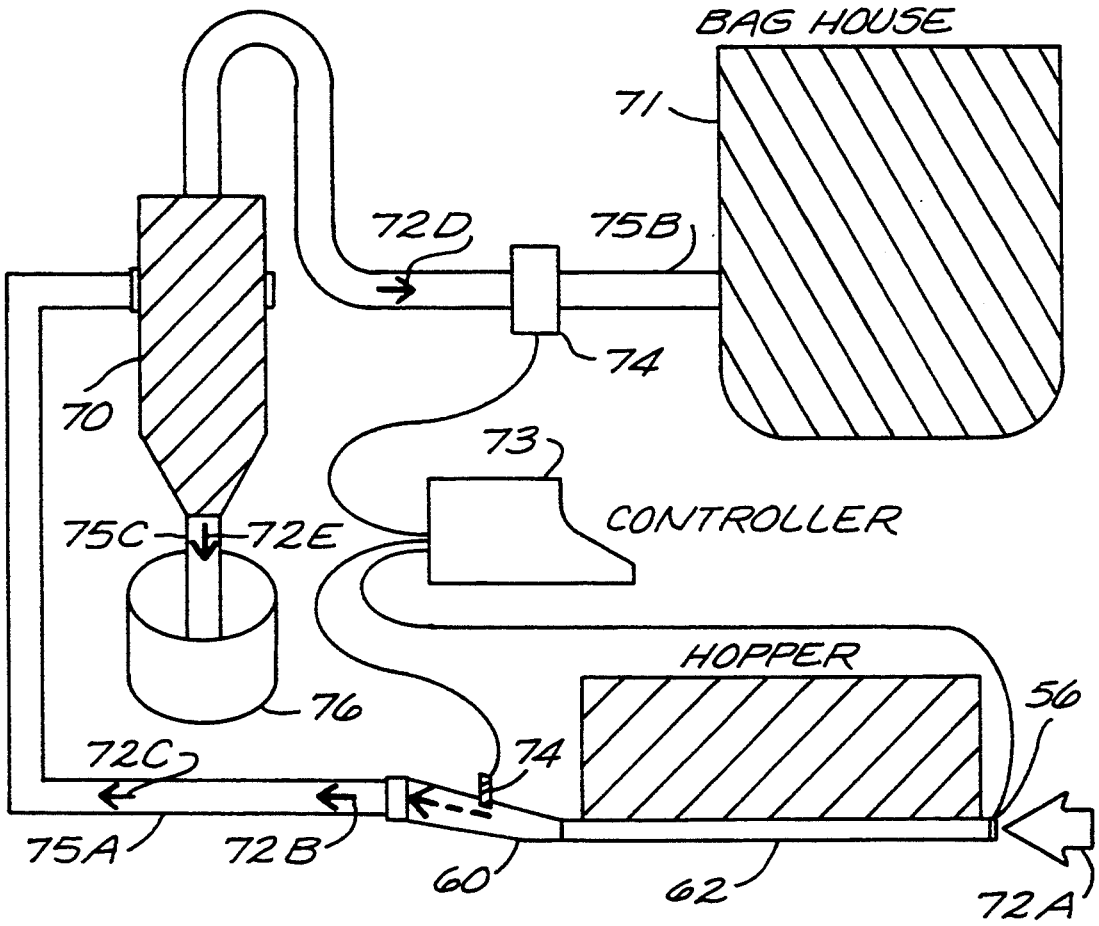
FIG. 7 is a block diagram of the preferred media recovery system.

FIG. 7 is a block diagram of the preferred media recovery system.

Hopper 62 accepts the media/debris from the operator in a manner discussed before. The mixture is conveyed through air flow 72A through adapter 60 and into ducting 75A, as indicated by arrow 72B, to cyclone 70 as indicated by arrow 72C.

Cyclone 70 is any of a number of cyclones or other such mechanism used to create a suction and are well known to those of ordinary skill in the art.

Cyclone 70 separates the mixture through centrifugal force and pushes the debris and dust via duct 75B, as indicated by arrow 72D to bag house 71; media is pushed from cyclone 70 through duct 75C as indicated by arrow 72E to collection bin 76.

Overseeing the entire operation is controller 73 which is any of a variety of electronic controlling mechanisms well known to those in the art such as a microprocessor or a computer.

Controller 73 utilizes the signals from the wind-speed indicator 74 to determine if the proper air flow is occurring through hopper 62. Adjustments are made to keep the air flow within a specified range through adjustment of cyclone 70 via connector 74.

Further adjustments are implemented through manipulation of valve 56 by controller 73. Valve 56, and others such valves, control the air flow through the air flow channel in the hopper.

In this manner, the entire operation is monitored and controlled to obtain an optimal operating mechanism.

The invention creates a new and improved floor recovery hopper and system employing the hopper.

What is claimed is:

1. A floor recovery hopper comprising:

a) a housing member having a first, second, third, and fourth walls extending vertical to a horizontal base plate, said first wall being shorter than the second, third, and fourth walls, said second and fourth walls having orifices in close proximity to said base plate, a top portion of said housing member being open;

b) a channeling member having a series of ridges and valleys, said channeling member interposed within said housing member such that said ridges run from said second wall to the fourth wall and wherein said valleys are above the orifices in said second and fourth walls, said valleys having a series of drop orifices;

c) a screen member extending over the entirety of a top opening; and, d) a ramp member extending from a plane in line with said base plate to the top of said first wall.

2. The floor recovery hopper according to claim 1 further including means for vibrating said screen member.

3. The floor recovery hopper according to claim 2 wherein said means for vibrating is activated by externally supplied air pressure.

4. The floor recovery hopper according to claim 2 further including an adapter member having a circular collar with an opening therein, said opening communicating with the orifices in the second wall of said housing.

5. The floor recovery hopper according to claim 4 wherein a cross-sectional area of the opening in said circular collar is equal to a cross-sectional area of said orifice in said fourth wall.

6. The floor recovery hopper according to claim 5 wherein a total cross-sectional area of all of said drop orifices is less than the area of the opening in said circular collar.

7. The floor recovery hopper according to claim 4 further including a wind flow sensor positioned in said adapter member and generating an electronic wind-speed signal.

8. The floor recovery hopper according to claim 2 further including at least two conduit members, each of said conduit member having an air channel communicating with a selected group of the drop orifices.

9. A media collection apparatus comprising:

a) a housing member having four walls extending vertical to a horizontal base plate, one of said walls being shorter than the others, two of said walls having orifices in close proximity to said base plate, a top portion of said housing member being open;

b) a channeling member having a series of ridges and valleys, said channeling member interposed within said housing wherein said valleys are above the orifices in said walls, said valleys having a series of drop orifices; and, c) a screen member extending over the entirety of the top opening.

10. The media collection apparatus according to claim 9 further including means for vibrating said screen member.

11. The media collection apparatus according to claim 10 wherein said means for vibrating is activated by externally supplied air pressure.

12. The media collection apparatus according to claim 10 further including an adapter member having a circular collar with an opening therein, said opening communicating with the orifice in one of said walls of said housing.

13. The media collection apparatus according to claim 12 wherein a cross-sectional area of the opening in said circular collar is greater than a cross-sectional area of the orifice in one of said walls.

14. The media collection apparatus according to claim 13 wherein a total cross-sectional area of all of said drop orifices is less than the area of the opening in said circular collar.

15. The media collection apparatus according to claim 12 further including a wind flow sensor positioned in said adapter member and generating an electronic wind-speed signal.

16. The media collection apparatus according to claim 10 further including at least two conduit members, each of said conduit member having an air channel communicating with a selected group of the drop orifices.

17. A floor recovery system comprising:

a) a media hopper having, 1) a housing member having a first, second, third, and fourth walls extending vertical to a horizontal base plate, said first wall being shorter than the second, third, and fourth walls, said second and fourth walls having orifices in close proximity to said base plate, a top portion of said housing member being open, 2) a channeling member having a series of ridges and valleys, said channeling member interposed within said housing member such that said ridges run from said second wall to the fourth wall and wherein said valleys are above the orifices in said second and fourth walls, said valleys having a series of drop orifices, 3) a screen member extending over the entirety of the top opening, 4) a ramp member extending from a plane in line with said base plate to the top of said first wall, said ramp accepting operator pushed media from a floor, and, 5) adapter member having a circular collar with an opening therein, said opening communicating with the orifices in the second wall;

b) a collection means for holding media; and, c) suction means connected to the circular collar of said adapter, for drawing air through said orifice in the fourth wall, via the orifices in the second wall, and exhausting the air and media mixture into said collection means.

18. The floor recovery system according to claim 17 further including means for vibrating said screen member.

19. The floor recovery system according to claim 18 wherein said means for vibrating is activated by externally supplied air pressure.

20. The floor recovery system according to claim 18 wherein a cross-sectional area of the opening in said circular collar is greater than a cross-sectional area of said orifice in said fourth wall of said housing.

21. The floor recovery system according to claim 20 wherein a total cross-sectional area of all of said drop orifices is less than the area of the opening in said circular collar.

22. The floor recovery system according to claim 18 further including a wind flow sensor positioned in said adapter member for generating an electronic wind-speed signal indicative of wind speed in said adapter member.

23. The floor recovery system according to claim 22 further including control means for adjusting said suction means so that said electronic wind-speed signal approximates a preselected signal.

24. The floor recovery systems according to claim 23 wherein said control means includes means for accepting operator input of said preselected signal.

25. The floor recovery system according to claim 17 further including at least two conduit members, each of said conduit member having an air channel communicating with a selected group of the drop orifices.

* * * * *